United States Patent [19]

Doyel

[11] 3,960,307

[45] June 1, 1976

[54] APPARATUS FOR ATTACHING ORNAMENTS TO SHEET MATERIAL

[76] Inventor: John S. Doyel, 404 W. 20th St., New York, N.Y. 10011

[22] Filed: June 16, 1975

[21] Appl. No.: 587,282

Related U.S. Application Data

[63] Continuation-in-part of Ser. No. 479,522, June 14, 1974, abandoned.

[52] U.S. Cl. ..... 227/144; 227/149

[51] Int. Cl.² ..... B25C 1/00

[58] Field of Search ..... 227/144, 147, 149

[56] References Cited

UNITED STATES PATENTS

| | | | |
|---|---|---|---|
| 1,186,411 | 6/1916 | Manning | 227/144 |
| 1,513,356 | 10/1924 | Watson | 227/144 |
| 2,361,501 | 10/1944 | Salzberg | 227/144 |

*Primary Examiner*—Granville Y. Custer, Jr.
*Attorney, Agent, or Firm*—Cooper, Dunham, Clark, Griffin & Moran

[57] ABSTRACT

Disclosed is an apparatus for attaching an ornament by a pronged setting to sheet material, which includes a base having an anvil in the form of a turret on which the sheet material is placed and a pivotally connected head which receives the setting. A plunger on the head registers with the anvil when the head is pivoted relative to and toward the base. The plunger comprises a sleeve and a punch reciprocable axially within the sleeve. The sleeve contacts the sheet material and holds it in engagement with the anvil, and the punch moves axially within the sleeve to force the prongs of the setting into and through the sheet material and to deform the prongs so as to fasten the ornament to the material. A spring is disposed between the sleeve and the plunger to permit relative axial movement therebetween and to bias them apart after the ornament has been affixed. A pin extends radially through registered slots in the punch and the sleeve to attach them together and to limit the extent of relative movement therebetween. The slots are arranged in a manner which greatly facilitates the manufacture and assembly of the punch and sleeve. Different plungers can be readily attached to the head for use with different ornaments.

4 Claims, 15 Drawing Figures

Fig. 4.
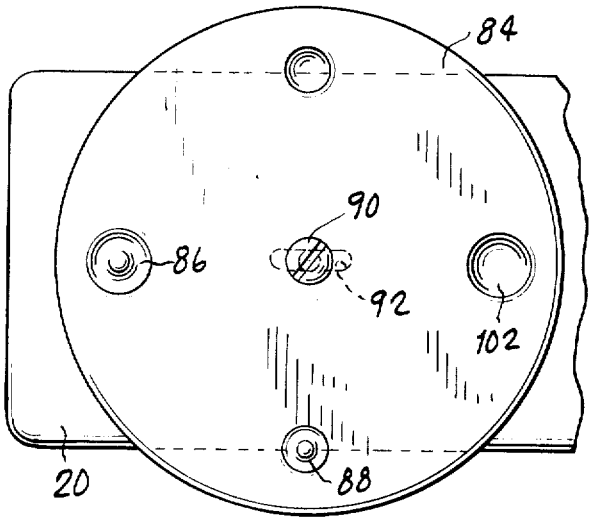
Fig. 5.
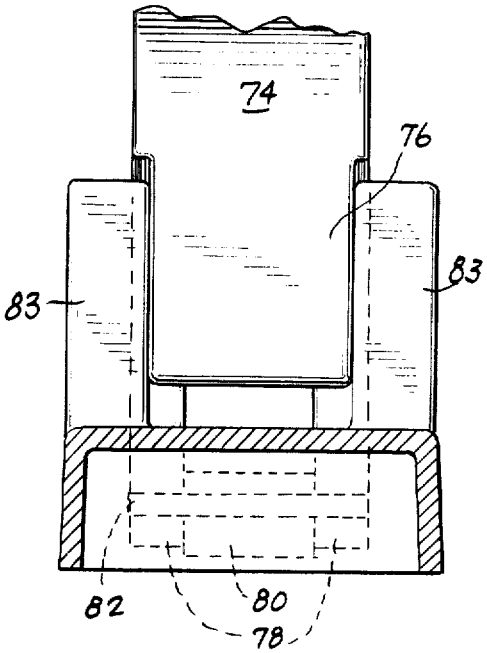
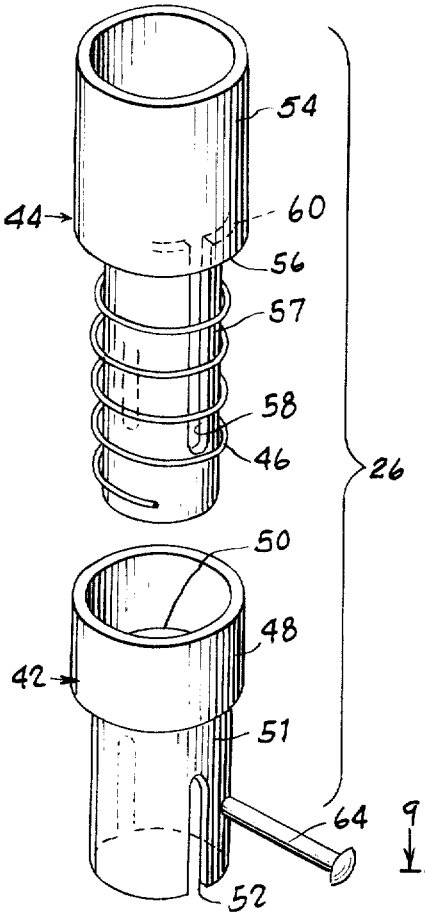
Fig. 6.
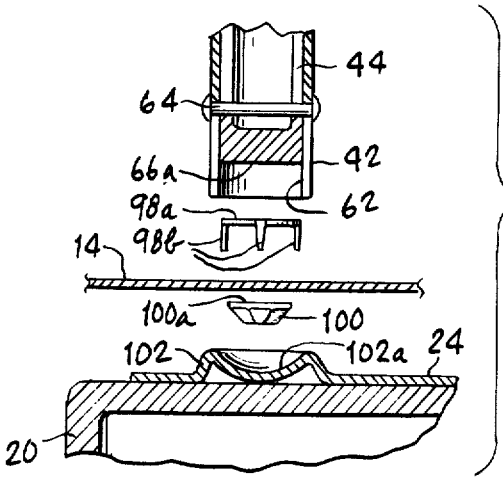
Fig. 7.
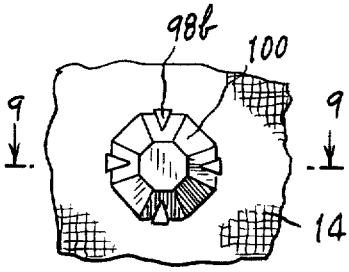
Fig. 8.
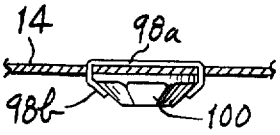
Fig. 9.

30
22
38
36
34
34e
12
42
34c
34a
40
34b
36
34d
44a
44b
44
54
57
58
46
50
48
42
51
52
64'
56
60
44
58
57
44
44a
44b
58
58
52
42
44
64'b
64'b
64'
64'b
58
64'b
64'
64'a
64'b
64'a
64'a
64'b
64'a

APPARATUS FOR ATTACHING ORNAMENTS TO SHEET MATERIAL

REFERENCE TO A RELATED APPLICATION

This application is a continuation-in-part of the earlier application of the applicant herein entitled Apparatus for Attaching Ornaments to Sheet Material filed on June 14, 1974, under Ser. No. 479,522, now abandoned. Applicant hereby incorporates by reference into this specification all of the subject matter disclosed or claimed in said earlier application.

BACKGROUND OF THE INVENTION

The present invention relates to setting to sheet material ornaments such as gems or studs.

Devices for attaching ornaments to fabric or other sheet material are known. For example, in U.S. Pat. No. 3,483,603, a device for attaching ornaments to fabric, plastic, leather or garments has a plunger mounted for reciprocation in a one-piece U-shaped frame. One leg of the frame serves as a base and the other leg contains the plunger. A pin is reciprocable in a bore in the plunger and is resiliently urged toward a downward and outward projecting position. A spring disposed around the plunger and cooperating with the frame urges the plunger upwardly. A die carried by the frame base is aligned with the plunger and the pin. The setting to be fastened must have a central hole in its base so that it can be positioned on the pin for mounting. As the plunger is depressed, the central pin retracts, and the plunger forces the prongs of the setting into and through the sheet material. See also U.S. Pat. No. 2,721,999.

There are various disadvantages with the above described device. The plunger is not supported through any substantial portion of its length. Therefore, as the plunger reciprocates, it may not precisely register with the die. A further disadvantage is that the device does not readily convert to accept different size ornaments and settings. It is necessary to unscrew a threaded bushing, replace the pin mounted in the plunger with a different size pin and then replace the bushing with one of a different size. It is also necessary to replace the die member or anvil. Furthermore, the setting must be of a type having a central hole of a specific size in its base.

Other devices for fastening pronged elements to sheet material are shown in U.S. Pat. Nos. 1,513,356; 2,361,501; 2,700,090; 2,759,184 and 3,520,462.

SUMMARY OF THE INVENTION

An object of the present invention is to provide an inexpensive, hand-operated apparatus for attaching ornaments, such as gems and studs, to sheet material, such as fabric used for clothing.

A further object of the invention is to provide apparatus for attaching ornaments to sheet material in precise locations.

Still another object of the invention is to provide apparatus for mounting gems, studs and the like to sheet material which is readily convertible to affix ornaments of varying size and type.

The present invention provides for these purposes apparatus for attaching an ornament to sheet material which includes a base, a head pivotally connected to the base and adapted to hold the ornament setting, an anvil secured to the base and adapted to receive the sheet material and plunger means attached to the head and registrable with the anvil when the head is pivoted relative to and toward the base.

The plunger means includes a sleeve which engages the sheet material as the head pivots relative to and toward the base to hold the material in engagement with the anvil. A punch fixed in position relative to the head travels with the sleeve as the head is pivoted, and travels axially relative to the sleeve after the sleeve has contacted the sheet material. The punch forces the prongs of the setting into and through the sheet material to fasten them together. A spring is disposed between the sleeve and the punch to permit relative axial movement therebetween and to bias them apart after the setting has been fastened. The sleeve has a pair of oppositely disposed, axially extending slots and the punch has a pair of oppositely disposed, axially extending slots in registration with the slots of the sleeve. A pin extends radially through each of the registered slots to attach the punch and the sleeve while limiting the extent of relative axial movement therebetween. A stop is attached to the head to prevent relative movement between the punch and the head. The slots are arranged in a manner which greatly facilitates the manufacture and assembly of the plunger means.

The anvil is preferably in the form of a turret which is connected to and positionable with respect to the base. The turret has at least one matrix or die for deforming the prongs to fasten the ornament to the sheet material. The turret has a centrally located opening and the base has a slot registrable therewith. A screw extends through the opening and slot and is engageable with the turret and the base to affix the turret in position such that the desired matrix is registered with the punch.

A guide is located on the base and on the head for permitting only pivotal movement in a vertical plane between the base and the head. This prevents the punch from misregistering as the head is pivoted relative to the base.

BRIEF DESCRIPTION OF THE DRAWINGS

FIG. 4 is a sectional view taken along the line 4—4 of FIG. 1;

FIG. 5 is a sectional vew taken along the line 5—5 of FIG. 1;

FIG. 6 is an exploded perspective view of a plunger means of the apparatus of FIG. 1;

FIG. 7 is a partial sectional view of a modified embodiment of the apparatus;

FIG. 8 is a top view of a gem as attached to sheet material by the apparatus of FIG. 7;

FIG. 9 is a sectional view taken along the line 9—9 of FIG. 8;

DETAILED DESCRIPTION

Figure 1:
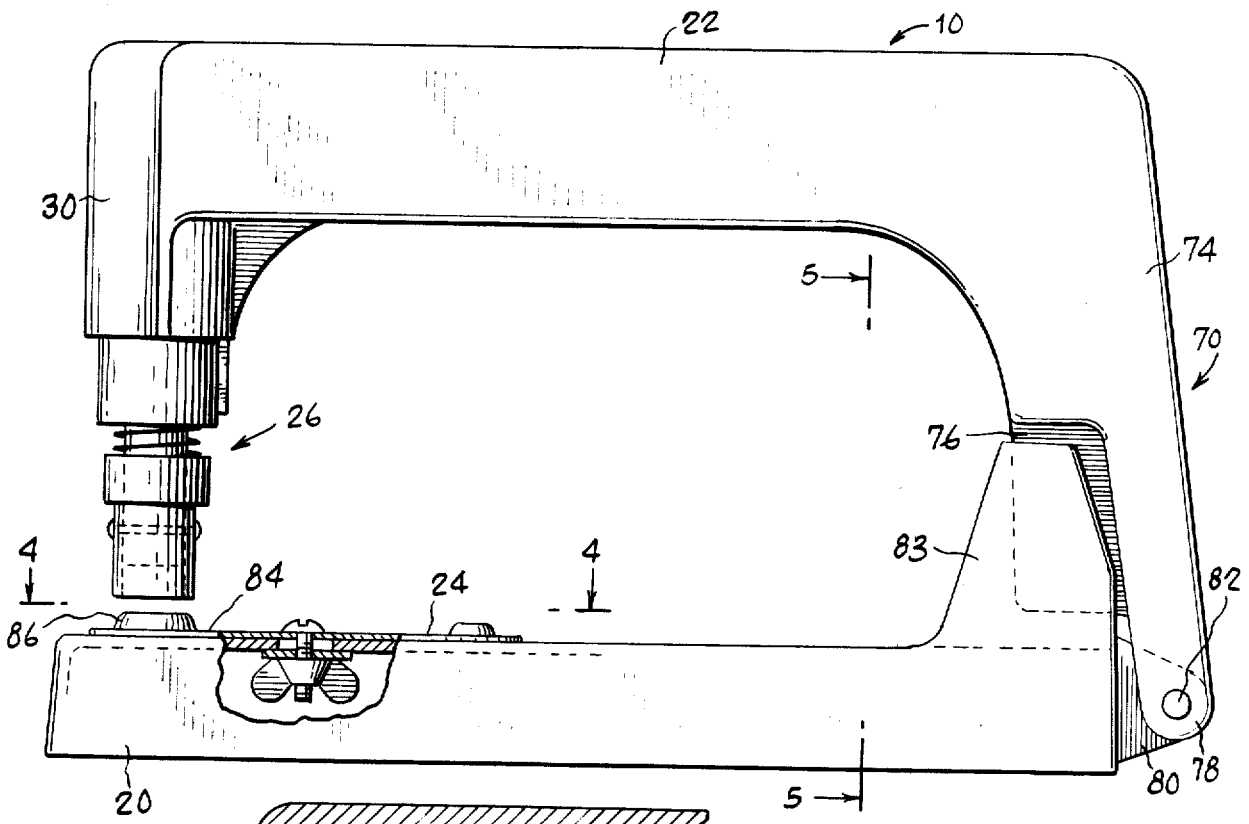
FIG. 1 is an elevational view of apparatus in accordance with the present invention.
Figure 2:
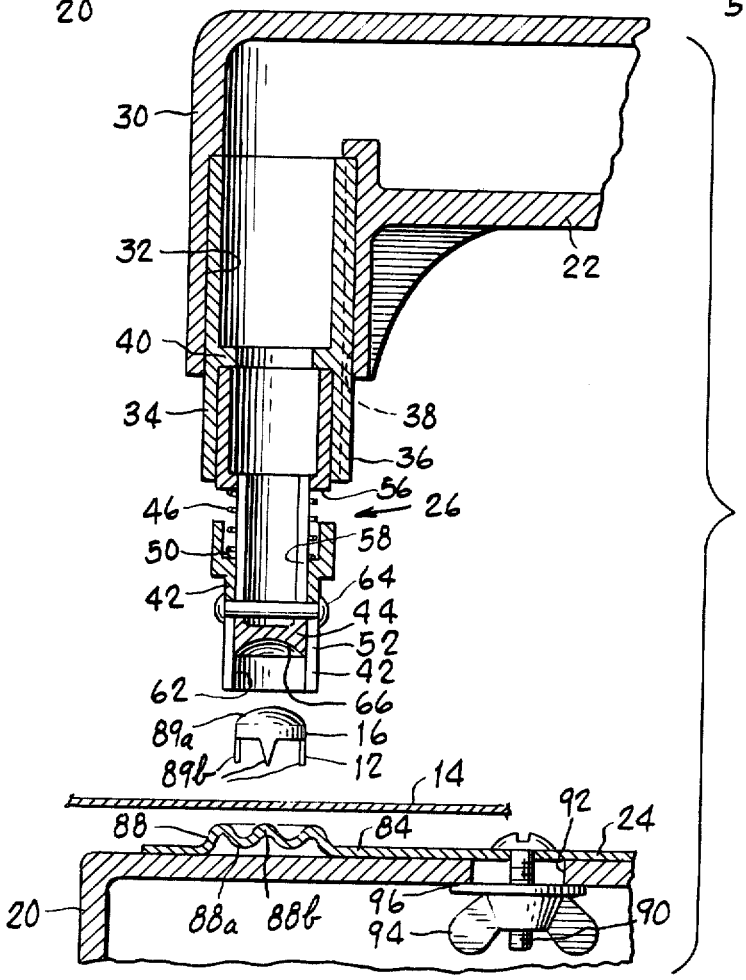
FIG. 2 is a partial sectional view of the apparatus of FIG. 1.

Referring to FIGS. 1 and 2 of the drawings, there is shown an apparatus 10 for attaching an ornament 12 to sheet material 14 by a pronged setting 16. The term "ornament" as used herein comprises the entire object to be affixed to the sheet material; the term "setting" means the fastener by which the decorative portion of the ornament is affixed to the material. Thus, the ornament 12 shown in FIG. 1 consists of the pronged stud 16 which has a head or crown 89*a* and prongs 89*b*, while the ornament shown in FIGS. 7–9 consists of the gem 100 and the setting 98. The apparatus 10 is lightweight and substantially fabricated of a high-strength plastic material such as high-impact styrene. It is inexpensive to manufacture and simple to use. It is capable of mounting a variety of gems, studs and other ornaments to sheet material such as fabric or clothing. It is easily convertible to receive ornaments of varying size.

The apparatus 10 comprises a base 20 and a head 22 pivotally connected at its right-hand end to the right-hand end of the base 20. A large space is defined by and between the head 22 and the base 20 to receive large pieces of fabric. An upwardly facing anvil 24 is located at the left-hand end of the base 20 and is adapted to receive the sheet material 14 thereupon. A plunger 26 adapted to hold the setting is attached to the head 22 at its left-hand end, extending toward the base 20, and cooperates with the anvil 24 when the head is pivoted relative to the base. As the plunger 26 is depressed, it forces the prongs 89*b* of the setting 16 into and through the sheet material 14. The prongs are deformed on the anvil, and the setting 16 is thereby fastened to the sheet material, with the head or decoration 89*a* being on one side of the sheet material 14 and the prongs 89*b* being on the other side.

The head 22 is an elongated, laterally extending member reinforced by internal ribs or by a truss (not shown). The head terminates at the left side in a downwardly extending arm 30 having a recess 32 open at its lower end. A bushing 34 is frictionally fitted within the recess 32. The bushing 34, which is tubular in shape and is formed in two longitudinal halves, has an axially extending key 36 on its right outer surface. The key 36 fits within an axially extending keyway 38 formed in the recess 32 of the arm 30 to prevent the bushing 34 from rotating when placed in the recess. A ring comprising a stop 40 is formed integrally with and internally of the bushing 34.

Figures 10, 11, 12, 13, 14, 15:
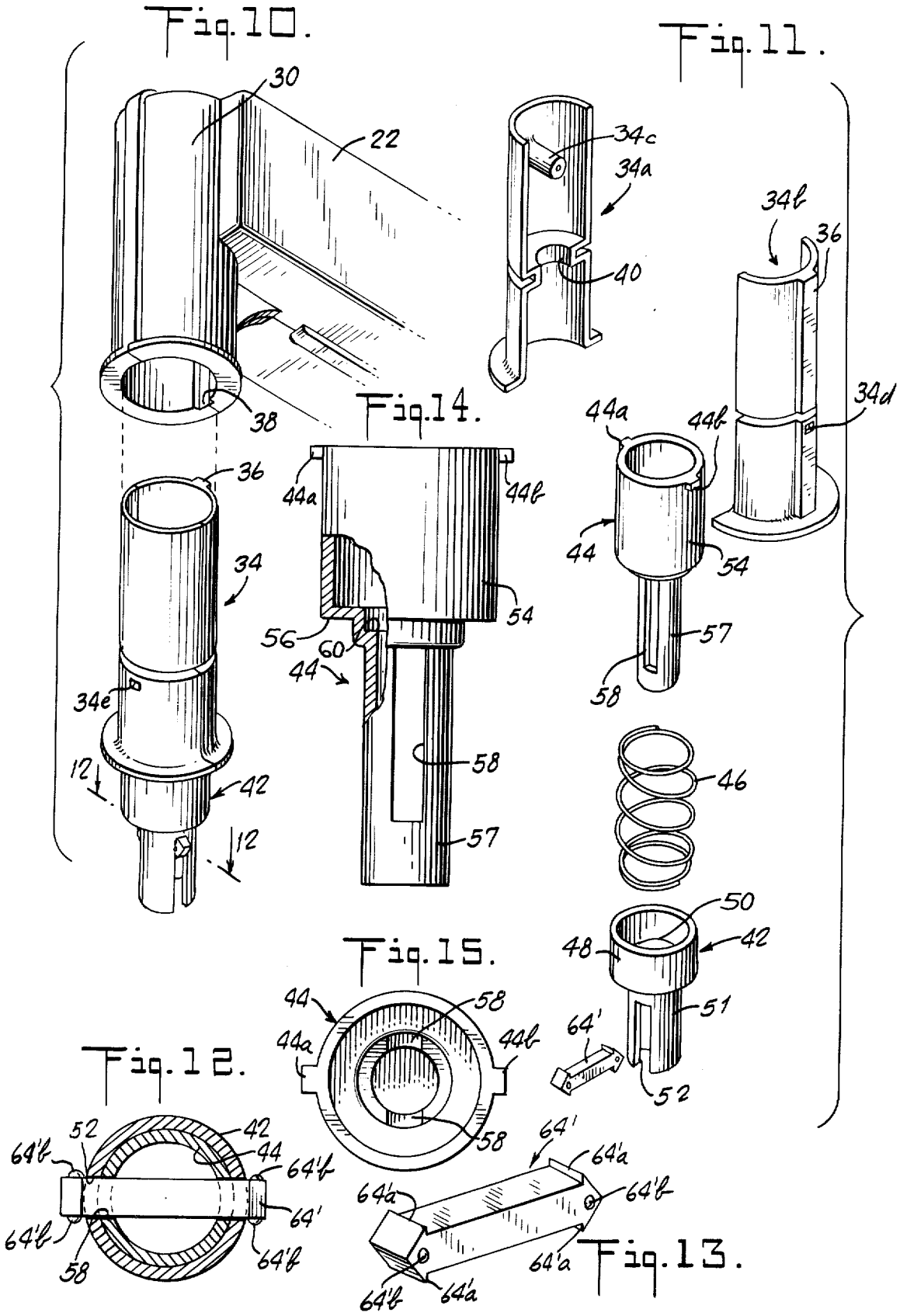
FIG. 10 is a perspective, partial exploded view of a head and a plunger means of a modified embodiment in the invented apparatus.
FIG. 11 is a perspective exploded view of the plunger means of FIG. 10.
FIG. 12 is a sectional view along line 12—12 of FIG. 10.
FIG. 13 is a perspective view of a retainer pin of the plunger means of FIG. 10.
FIG. 14 is a partly elevational and partly sectional side view of a punch of the plunger means of FIG. 10.
FIG. 15 is a top view of the punch of FIG. 14.

Referring to FIGS. 10 and 11, which show a slightly modified embodiment of the invention, the bushing 34 comprises two halves 34*a* and 34*b* that can be brought together to form the generally cylindrical bushing 34, at which time the pin 34*c* of the half 34*a* fits tightly into a correspondingly shaped and dimensioned tubular pin (not visible) of the half 34*b* to lock the two halves into a single bushing. The half 34*b* has the key 36 which fits slidingly into the keyway 38 of the left-hand portion 30 of the head 22 to thereby prevent relative rotation between the bushing 34 and the head portion 30.

The plunger 26 for forcing prongs of the setting 16 into the sheet material 14 telescopically engages and is held within the bushing 34 by means of lugs 44*a* and 44*b* (FIG. 11) at its upper end which engage holes 34*d* and 34*e* (FIGS. 10, 11) in the bushing 34. Alternatively, the plunger may be frictionally fitted within the bushing 34. It is prevented from moving further up axially of the bushing 34 by the stop 40. The plunger 26 is best seen in FIGS. 2, and 6, and the component parts thereof are best seen in FIGS. 10–15. As shown therein, the plunger 26 includes a sleeve 42 which is adapted to engage the sheet material with its bottom end and hold it in secure engagement with the anvil 24. A punch 44, which telescopically engages and is fitted within the bushing 34, is connected to sleeve 42. The punch 44 travels with the sleeve 42 as the head pivots relative to the base, but reciprocates axially within the sleeve 42 and travels relative thereto after the sleeve 42 contacts the sheet material. The punch 44 forces the prongs of the setting 16 into and through the sheet material 14. A spring 46 is disposed between the sleeve 42 and the punch 44 for permitting relative movement therebetween and for biasing them apart after the setting has been affixed.

The sleeve 42 is generally tubular in shape and has an enlarged diameter collar 48 at its axially upper end. The collar 48 is preferably formed integrally with the sleeve, although it may be a separate piece affixed to the sleeve. A shoulder 50 is formed at the location where the enlarged collar merges into the lesser diameter, lower tubular portion 51 of the sleeve. A pair of diametrically oppositely disposed, axially extending, slots 52 are formed in the sleeve in the tubular portion 51. The slots 52 are open at the bottom but terminate prior to the upper end of the sleeve 42.

The punch 44 is generally tubular in shape, and is similar in shape to the sleeve 42. It also has an enlarged diameter, integrally formed collar 54 at its upper end. The collar 54 is adapted to telescopically engage, and is fitted within, the bushing 34 of the head 22. A shoulder 56 is formed at the location where the collar 54 merges into the lesser diameter tubular portion 57 of the punch 44. A pair of axially extending, diametrically oppositely disposed slots 58 are formed in the tubular portion 57. The slots 58 extend from a shoulder 60 (formed internally of the punch 44 at the location where the shoulder 56 is formed externally) along the length of the tubular portion 57, but not entirely therealong. As seen in FIGS. 2, 6, 11, 14 and 15, the slots 58 in the punch 44 start at a level above the bottom end of the punch 44 and are open at the top end of the lesser diameter, lower portion 57 of the punch 44.

The external diameter of the tubular portion 57 of the punch 44 is slightly less than the internal diameter of the tubular portion 51 of the sleeve 42. Thus, the punch 44 can telescopically engage the sleeve 42 and be positioned within the throat 62 of the sleeve. When so arranged, the slots 58 in the punch 44 are in register with the slots 52 in the sleeve 42. A pin 64 extends radially through each of the slots 52 and slots 58 to fasten the punch and the sleeve together while permitting relative axial movement therebetween.

The spring 46 is disposed between the punch 44 and the sleeve 42. In particular, the spring 46 is a coil spring surrounding the tubular portion 57 of the punch 44 and located between the shoulder 56 of the punch and the shoulder 50 of the sleeve. The spring 46 normally urges the punch and the sleeve axially apart.

The punch 44 has a solid surface 66 near its lower end. In the embodiment shown in FIG. 2, this surface 66 is concave. Thus, the setting 16 may be positioned within the throat 62 of the sleeve in engagement with the surface 66 of the punch. The internal diameter of the throat 62 is selected such that the setting 16 can be held therein by friction.

The disclosed construction of the plunger 26, and particularly the manner in which the slots 52 and 58 are arranged and the manner in which the plunger 26 is assembled, provide significant manufacturing and assembly advantages. Specifically, the fact that the slots 52 in the sleeve 42 are open at the bottom of the sleeve 42 allows the sleeve 42 to be molded from plastic material in a single step, with a die forming the slots 52, thus obviating the need to later provide slots or openings in the sleeve 42 by a subsequent machining operation. Similarly, the arrangement of the slots 58 in the punch 44 means that the entire punch can be molded, with the slots 58 therein, to thus obviate the need for a subsequent machining operation for making slots or openings. In molding of the punch 44, a die forms the slots 58. Since the slots 58 are open at the top end of the lesser diameter tubular portion 57, and since the outside diameter of the lesser diameter tubular portion 57 is less than the inside diameter of the collar 54, as shown in the drawing, the punch 44 can be molded in a single operation, with the slots 58 formed by a die inserted coaxially into the punch 44 from the top open end thereof. As seen in FIGS. 11, 12 and 13, the retaining pin 64' is elongated and has enlarged heads at the longitudinally spaced ends. More specifically, each longitudinal end is arrow-shaped in a longitudinal section transverse to the plane of FIG. 12, forming thus retaining ridges 64'*a*. Additionally, the retaining pin 64 has outwardly-extending projections 64'*b* from each side of the head which does not have a ridge 64'*a*. Referring to FIGS. 11–13, the plunger 26 is assembled by placing the spring 46 from below onto the lesser diameter tubular portion 57 of the punch 44 and then moving the lesser diameter portion 57 of the punch 44 into the sleeve 42, from above the sleeve 42, until the slots 58 and 52 overlap over an area least equal to the largest transverse section of the retaining pin 64'. The retaining pin 64' is then inserted into the overlapping slot area until it is in the position shown in FIG. 12. It is noted that the punch 44, sleeve 42 and retaining pin 64' are made of a somewhat resilient plastic material so that each can deform somewhat in the course of inserting the retaining pin 64' and can return to its original shape subsequently, to thus ensure that the retaining pin 64' stays in place during the operation of the device. This manner of arranging and assembling the punch 44, sleeve 42 and retaining pin 64' ensures that each can be made in a single molding operation, without any subsequent machining operations, and that the punch can be assembled by hand, without the need for special machinery.

At the right-hand end of the head 22, opposite the arm 30 containing the plunger 26, guide means 70 are provided at the connection to the base 20. The guide means 70 allow the head to pivot relative to the base only in a vertical plane. Thus, the plunger 26, fixed at the opposite left-hand end of the head 22, also pivots only in a vertical plane. The guide means 70 is best viewed in FIGS. 1 and 5. The right-hand end of the head 22, opposite the arm 30, terminates in a downwardly extending arm 74. In its central region, the arm 74 has a depressed, pinched portion 76. At the bottom end of the arm 74, a yoke 78 is formed. The base 20 has a lug 80 at its right-hand end, opposite the anvil 24. The yoke 78 fits about the lug 80, and the two are secured together by a pin 82 to pivot relative to one another. A pair of upright flanges 83 are formed at the same right-hand end of the base 20. The depressed portion 76 of the arm 74 fits between the flanges 83 to prevent horizontal translational or pivotal movement of the arm. There is thus a dual system for limiting movement relative to the vertical plane: one system results from the engagement of the depressed portion 76 and the flanges 83, and the other results from the engagement of the yoke 78 and the lug 80. This ensures that the head 22 and hence the plunger 26 move only in a vertical plane during fastening of the ornament 12 to the sheet material 14.

The base 20 is generally similar in construction to the head 22 and comprises an elongated member which may be reinforced internally by ribs or by a truss (not shown). At the left end of the base 20, opposite the lug 80 at which the head is pivotally connected, is the anvil 24.

Figure 3:
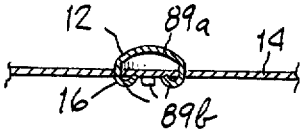
FIG. 3 is a sectional view of an ornament as attached to sheet material by the apparatus of FIG. 1.

As best seen in FIG. 4, the anvil 24 preferably comprises a turret 84 attached to and rotatable with respect to the base 20. The turret 84 is provided with at least one and preferably several matrices or dies 86. The turret 84 is preferably stamped of sheet metal. Alternatively, the turret 84 may be fabricated of plastic, but the dies 86 should be made of a high-strength material, such as steel, because they absorb the force of the punch 44 and the ornament prongs. The dies 86 are desirably spaced about the periphery of the turret 84. Each die 86 is of a different size and is shaped so as to deform the prongs of the setting 16. As shown in FIG. 2, one die 88 is shaped to have a circular concave portion 88*a* and a central peak 88*b*. An ornament 12, which is a stud or setting 16 that comprises a domed decoration or crown 89*a* and a plurality of prongs 89*b*, is forced through the sheet material 14 and the prongs 89*b* are bent inwardly and upwardly by the concave portion 88*a* to the top of the peak 88*b* and thence back into the material to secure the ornament 12 to the material, as shown in FIG. 3.

The turret 84 is connected to the base 20 such that its position can be adjusted both longitudinally and circumferentially with respect to the base. As shown in FIGS. 1, 2 and 4, this connection comprises a screw 90 extending though a central opening 91 in the turret 84 and a slot 92 formed in and arranged longitudinally of the base, and secured by a wing nut 94 and a washer 96. When the wing nut 94 is loosened, the turrent 84 can rotate relative to the base such that a selected one of the dies 86 is positioned beneath and in register with the punch 44. Moreover, the turret 84 can be positioned longitudinally of the base by sliding the turret 84 and the screw 90 along the slot 92. This results in precise alignment of the punch and the die. Other adjustment means may also be employed.

In operation of the apparatus 10 to affix an ornament to sheet material, the user places an ornament 12 in the throat 62 at the bottom end of the sleeve 42 of the plunger 26. The decoration 89*a* and the setting 16 are held by friction in contact with the curved surface 66 near the lower end of the punch 44 and by the throat 62 of the sleeve 42. The sheet material 14 is placed on top of a selected, corresponding one of the dies 88 of the anvil 24. The user pushes down on the head 22 such that it pivots about the pin 82. As the arm 30 of the head moves downwardly, the lowermost surface of the sleeve 42 engages the sheet material 14 and holds it in contact with the die 88. It should be clear, of course, that if the prongs 89*b* protrude downwardly from the sleeve 42, the prongs would first engage the sheet material 14 and the sleeve 42 may or may not subsequently engage the sheet material 14. Continued pressure exerted by the user causes the punch 44 to move downward relative to the sleeve 42. The prongs 89*b* of the setting 16 are forced by the punch into and through the sheet material. The prongs 89*b* are deformed by the concave surface 88*a* and peak 88*b* of the die 88 and are bent inwardly and upwardly, and partly back through the under surface of the sheet material, as shown in FIG. 3. The ornament is thus affixed to the sheet material. It is within the scope of the invention to reverse the operation of the apparatus and to place the ornament 12 on a suitable die of the anvil 24 so that the prongs are deformed by the curved surface 66 at the lower end of the punch 44.

To convert the apparatus 10 to affix ornaments of a different size, the user removes the entire plunger from the head 22. This is accomplished by slipping downwardly the friction-fitted bushing 34 from the head arm 30, separating the halves 34*a* and 34*b* as shown in FIG. 11, removing the plunger 26 (without disassembly of the plunger) and replacing it with a different plunger having a throat of greater or lesser diameter and a lower surface of a greater or lesser curvature. Several different replacement plungers 26 are typically supplied with the apparatus 10, to match the several different dies of the anvil 24. It is one of the substantial advantages of the present invention that the plunger can be conveniently removed as a unit of facilitate conversion of the apparatus. The turret 84 is readily positioned by means of the wing nut 94 such that the desired die 86 is aligned relative to the punch 44. The turret 84 is also adjustable longitudinally of the base 20 by means of the screw 90 disposed within the slot 92 to provide precise alignment.

The apparatus 10 of the present invention is also suitable for applying to sheet material ornaments which have a separate gem and setting. As shown in FIG. 7 (where similar parts have been given the same number), the punch 44 has a flat bottom surface 66*a* so that the throat 62 of the sleeve 42 can receive and hold a setting 98 which has a flat crown 98*a* and a plurality of prongs 98*b* extending therefrom. In this embodiment, a gem 100 is frusto-conical in shape and has a flat base 100*a* which cooperates with the flat crown 98*a* of the setting 98.

In operation, the gem 100 is placed within a die 102 shaped to have a concave inner surface 102*a* corresponding to the general shape of the gem. The sheet material 14 is placed on top of the gem within the die. The setting 98 is friction-fitted within the throat 62 of the sleeve 42 and the head 22 is depressed. The lower end of the sleeve (or the lower ends of the prongs 98*b*) engages the sheet material and holds it against the die 102. Continued pressure on the head causes the punch to move relative to the sleeve and the punch 44 then forces the prongs 98*b* of the setting 98 through the sheet material 14. The prongs are deformed by the die 102 such that they at least partly surround the gem and affix it securely to the sheet material, as best seen in FIGS. 8 and 9. Other types of ornaments may also be affixed using the apparatus of the invention.

Thus, the present invention provides an inexpensive and simple hand-operated apparatus for attaching ornaments, such as studs and gems, by settings to sheet material. The apparatus is readily convertible to affix ornaments of varying size. The apparatus is suitable for attaching ornaments to fabric in precise locations.

It should be noted that orientation terms, such as left, right, above, below, etc., refer only to the orientation shown in the figures and are in no way intended to limit the manner in which the invented apparatus is to be oriented in use.

I claim:

1. Apparatus for attaching a pronged ornament to sheet material comprising:

a base and a head, and means for connecting the base and the head for movement toward and away from each other;

an anvil and means for connecting the anvil to the base for rotation in a plane transverse to the direction of relative movement between the base and the head and for movement along said plane with respect to the base, said anvil having a free surface facing the head;

a plunger and means for releasably connecting the plunger to the head, with the plunger extending from the head toward the anvil, said plunger comprising:

a sleeve having a pair of axially extending slots which are diametrically opposite each other and are open at the axially bottom end of the sleeve but terminate prior to the axially upper end of the sleeve;

a hollow, tubular punch having a axially lower portion closed at the axially bottom end of the punch and fitting slidably within said sleeve for axial movement with respect thereto, said lower portion of the punch having a pair of axially extending slots which are diametrically opposite each other and are open at the axially top end of said lower portion of the punch but terminate prior to the axially bottom end of the punch;

an elongated retainer pin extending through all four of the slots and having heads at the longitudinally spaced ends thereof which are slightly larger than the slots, to thereby retain the pin in place when the heads thereof are radially outwardly of the slots;

biasing means engaging said sleeve and punch and urging said sleeve and punch axially away from each other, toward a relative axial position in which the pin engages the terminating ends of the slots and the bottom end of the punch is spaced axially upwardly from the bottom end of the sleeve by a selected distance, and means for limiting the relative movement of the punch and the sleeve toward each other to prevent the bottom end of the punch from protruding from the bottom end of the sleeve;

whereby when the material is supported on the free surface of the anvil facing the head and the pronged ornament is frictionally inserted in the sleeve from below, with the prongs thereof pointing toward the anvil, the head and the base can be moved toward each other to engage the material with the prongs and the bottom end of the sleeve and to thence move the punch axially downwardly with respect to the sleeve to force the prongs through the sheet material and against the anvil and thereby deform the prongs and secure the ornament to the sheet material.

2. Apparatus as in claim 1 wherein the means for connecting the anvil to the base comprise means defining an elongated aperture in one of said anvil and base and an aperture in the other, said apertures being centrally located with respect to the anvil and in registration with each other, and a fastener extending through said apertures for rigidly connecting the anvil to the base, said fastener being releasable to allow the anvil to rotate with respect thereto and to translate with respect to the base along said elongated aperture.

3. Apparatus as in claim 1 wherein the means for connecting the base and the head comprise:

a pair of spaced-apart guide projections extending upwardly from the base;

an arm extending downwardly from the head and received between said guide projections in sliding contact therewith;

means defining a cylindrical opening in one of said head and arm and a pivot pin affixed to the other and journaled in said cylindrical opening, said pin and cylindrical opening extending along an axis transverse to the plane of movement of the plunger with respect to the anvil.

4. An apparatus for attaching an ornament to sheet material, the combination comprising:

a hollow, tubular sleeve having a pair of axially arranged, elongated slots in its wall which are diametrically opposite each other and are open at the axially bottom end of the sleeve but terminate prior to the axially top end of the sleeve;

a tubular punch having an axially lower portion whose diameter is less than the inside diameter of the sleeve, said axially lower portion of the punch being received axially within the sleeve in telescoping engagement, the punch having a pair of axially arranged, elongated slots in its wall in registration with the slots in the wall of the sleeve, the slots in the punch being closed at the axially bottom end of the punch but open at their top ends;

a pin extending through all four of the slots to hold the sleeve and the punch together and to limit the extend of their relative axial movement away from each other;

means for retaining the pin in its position extending through all four slots; and means for limiting the extent of the relative axial movement of the sleeve and punch toward each other.

* * * * *